United States Patent [19]

Harder

[11] Patent Number: 4,745,858

[45] Date of Patent: May 24, 1988

[54] ELECTRIC DETONATOR WITH STATIC ELECTRICITY SUPPRESSION

[75] Inventor: William C. Harder, Kingston, N.Y.

[73] Assignee: Ireco Incorporated, Salt Lake City, Utah

[21] Appl. No.: 911,781

[22] Filed: Sep. 26, 1986

[51] Int. Cl.[4] ..... F42B 3/18

[52] U.S. Cl. ..... 102/202.2; 102/202.5

[58] Field of Search ..... 102/202.2, 202.5, 202.9

[56] References Cited

U.S. PATENT DOCUMENTS

| | | | |
|---|---|---|---|
| 2,377,804 | 6/1945 | Narvarte | 102/202.2 |
| 3,264,989 | 8/1966 | Rucker | 102/202.2 |
| 4,271,453 | 6/1981 | Yajima et al. | 102/202.2 |

*Primary Examiner*—Charles T. Jordan

*Attorney, Agent, or Firm*—Thorpe, North & Western

[57] ABSTRACT

A static electricity protection system for use in electric detonators having an electrically conductive housing, and an ignition system contained in the housing. The static electricity protection system includes a pair of electrical conductors for carrying electrical current to the ignition system, with the conductors being generally disposed apart from one another and from the housing walls. A portion of each conductor is positioned adjacent to but not in contact with the housing and adjacent to but not in contact with a portion of the other conductor. This enables the discharge of static charge accumulation on either conductor to the housing with the result that ionization of air takes place to allow further discharge from the other conductor to the housing. In this way, the ignition system is protected from static electricity.

17 Claims, 1 Drawing Sheet

ELECTRIC DETONATOR WITH STATIC ELECTRICITY SUPPRESSION

BACKGROUND OF THE INVENTION

This invention relates to electric detonators generally and more particularly to a static electricty suppression arrangement for use in two-wire electric detonators.

Large explosive charges are detonated by initiating devices or detonators which are of two types—electric or nonelectric. An electric detonator (blasting cap) converts electrical energy into heat energy which, in turn, produces an explosive force capable of detonating a large explosive charge. The electrical energy is supplied to the detonator by two electrical conductors, called leg wires, which typically enter the detonator through a rubber or plastic sealing plug. The ends of the leg wires inside the detonator are joined together by a high resistant "bridge wire" which, when sufficient current flows through it, heats up to ignite a heat sensitive material which surrounds the bridge wire. This, in turn, ignites delay fuse elements to thus ignite or detonate a primary explosive charge which then detonates a base explosive charge. The explosive force developed by the base explosive charge is used to detonate the aforementioned large explosive charge.

The explosive charge's delay fuse elements, heat sensitive material, and sealing plug are encased in a cylindrical shell made of an electrically conductive material such as aluminum, bronze, etc. The plug is positioned in one end of the shell to hold the leg wires in positions spaced from the shell wall, and to guide the leg wires to the heat sensitive material.

Problems with electric detonators include static charge build-up on the leg wires, and static charge sources external to the detonator which, when in close proximity with the leg wires, cause current to flow through the leg wires and detonator to ground. Discharge of such static electricity through the bridge wire or the heat sensitive material can cause accidental/-premature detonation and result in serious injury to users. Conventional methods of dealing with static electricity generally involve the provision of a discharge path from each leg wire to the electrically conductive shell. The idea behind this is that if the static electricity can be "routed" around the bridge wire and explosive train via the shell, then dangerous premature detonation, at least that caused by static electricity, may be avoided. A problem and drawback of this approach is that slight differences in voltage breakdown between the two discharge paths can cause electrical current to flow through the bridge wire to prematurely initiate detonation.

SUMMARY OF THE INVENTION

It is an object of the invention to provide an electric detonator with improved static electricity suppression capabilities.

The above and other objects are realized in a specific illustrative embodiment of an electric detonator which includes an electrically conductive shell, an explosive initiating device disposed in the shell for producing an explosion in response to electrical current, an electrically non-conductive plug disposed within the shell at one end, and a pair of conductors which extend through the plug into the shell and are coupled to the explosive initiating device for carrying electrical current to the device. The electrical conductors extend initially into the plug disposed apart from one another and from the shell, and then a portion of each conductor is bent to extend to locations near the shell and near one another. From the locations, the conductors extend back away from the shell and from one another to the explosive initiating device.

Static charge build-up on one of the conductors, when it reaches a sufficient level, will discharge from that conductor to the shell. The spark created by the discharge ionizes the air gap and triggers a discharge from the other conductor to the shell so that electrical energy produced by static charge build-up is prevented from reaching the explosive initiating device.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
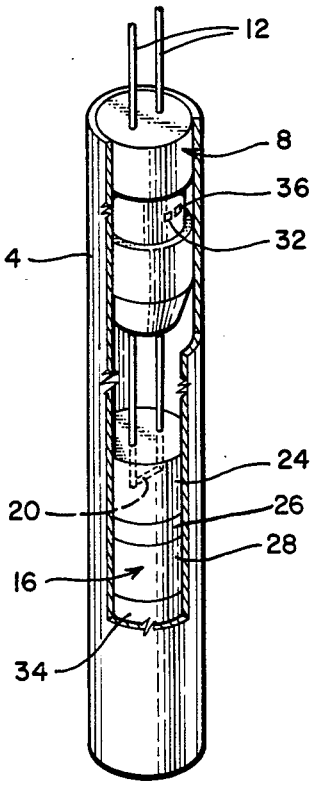
FIG. 1 shows a perspective, partially cut-away view of an electric detonator made in accordance with the principles of the present invention.

Referring to FIG. 1, there is shown one illustrative embodiment of an electric detonator made in accordance with the present invention and including an electrically conductive housing or shell 4 made, for example, of aluminum, bronze, or an alloy thereof. The shell 4 is formed as an elongate hollow cylinder to contain a sealing plug 8 at the upper end thereof. The sealing plug 8 is placed in the shell 4 to receive and guide a pair of leg wires 12 toward the interior of the shell and to prevent entry into the shell of moisture, water or contaminants. The plug 8 is made of a non-conductive material such as rubber or phenolic plastic. Oftentimes, the shell 4 is crimped about the plug 8 to securely hold it in place and complete the water-resistant seal.

The leg wires 12 are provided for conducting electrical current from a current source (not shown) to the interior of the shell 4 to an explosive initiating device 16. The device 16 is of conventional design and includes a bridge wire 20 which joins the two lower ends of the leg wires 12, a heat sensitive material 24 surrounding the bridge wire, a delay fuse element 26, a primary explosive charge 28, and a base explosive charge 34. When sufficient current is supplied to the bridge wire 20, it heats up to ignite the heat sensitive material 24 which, in turn, ignites the delay fuse element 26, the primary explosive charge 28 and then the secondary base explosive charge 34 to ultimately detonate a large working explosive charge. The heat sensitive material, primary explosive charge, delay fuse element, and base explosive charge are all conventional and well known.

Figure 2:
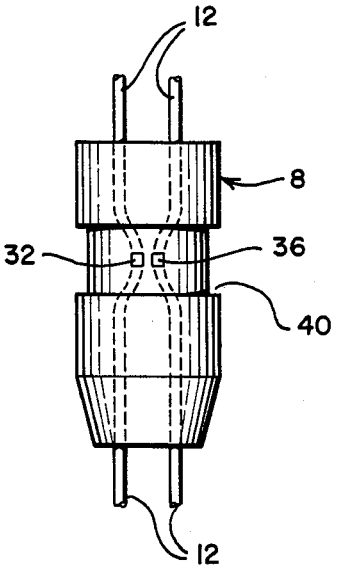
FIG. 2 is a front, elevational view of the plug and leg wires of the detonator of FIG. 1.
Figure 3:
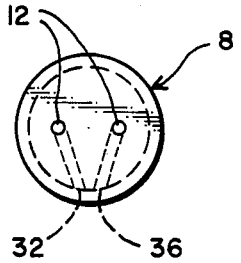
FIG. 3 is a top, plan view of the plug and leg wires.
Figure 4:
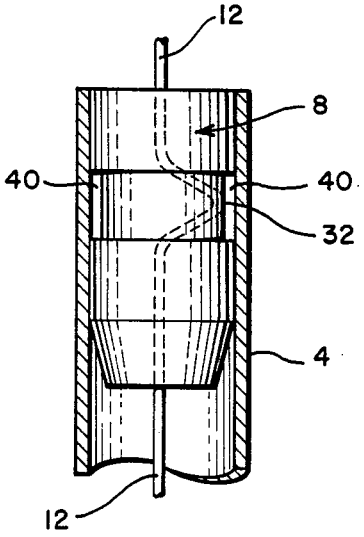
FIG. 4 is a side, elevational, partially cross-sectional view of the plug and leg wires shown disposed in the shell of the detonator.

The leg wires 12, as they enter the plug 8, are spaced apart from one another and from the shell 4 and positioned somewhat centrally in the plug. After extending a short distance into the plug, the leg wires then bend or curve outwardly toward the shell (see FIGS. 2–4) and towards each other to locations 32 and 36 where the wires are exposed at the exterior surface of the plug. The exterior surface where the locations 32 and 36 expose the leg wires is formed into a groove or recess 40 which circumscribes the plug. After reaching the exterior surface of the groove 40 of the plug 8, the leg wires curve or bend back toward the center of the plug and then downwardly to emerge out from the bottom end of the plug. From there, the leg wires extend into the explosive initiating device 16 where the ends of the leg wires are joined by the bridge wire 20.

The construction of the plug 8 and leg wires 12 shown in the drawings facilitates locating the exposed portions 32 and 36 of the leg wires 12 a precise distance from the shell 4. This distance is carefully selected to ensure discharge of static electricity from the leg wires to the shell. Additionally, the locations 32 and 36 are spaced a predetermined distance from one another for reasons that will be explained momentarily.

The plug 8 advantageously is constructed using a mold in which the leg wires 12 are prepositioned generally with the curved or bent sections extending to near or at the interior surface of the mold. The mold is formed to produce a plug without the groove or recess 40. With the leg wires in place in the mold, material for making the plug is poured into or applied to the mold to surround the leg wires. When the molding process is completed, the plug 8 is removed and then the groove 40 is formed by machining, cutting or the like to the desired depth. In the process of machining the groove 40, the portions 32 and 36 of the leg wires are exposed to the exterior which means that some of the wire material may be removed along with removal of the plug material.

For protecting against static sources having energy levels of about 400 millijoules, it has been found advantageous to provide a separation between the exposed locations 32 and 36, measured from the two adjacent edges of the locations, of from between about 0.005 inch to 0.026 inch. A separation greater than this may be desired for detonators having a higher firing current and/or higher voltage breakdown levels in the ignition system. It has also been found advantageous to provide an area of exposed wire for the locations 32 and 36 of about 0.030 by 0.030 inch, but likewise may be varied for different detonator designs. Finally, it has been found advantageous to provide a groove depth and thus a distance between the exposed locations 32 and 36, and the shell 4 of from between about 0.005 inch and 0.011 inch, but again, for different detonator designs, other groove depths may be preferred. With the specified dimensions, a static charge build-up on one of the leg wires can be discharged from the wire to the conductive shell 4, with the spark thus produced causing ionization of the air surrounding the exposed locations 32 and 36. As a result of the discharge from one wire to the shell, a voltage imbalance or difference between the wires is created. The ionized air, of course, provides improved conductivity between the other leg wire and the shell 4 causing it to also discharge to the shell through the ionized air. By placing the two exposed sections of the leg wires in close proximity, a discharge from one wire will ionize the air surrounding the other wire and vice versa. If the exposed locations 32 and 36 were not in close proximity, then discharge from one wire to the shell 4 would not produce ionization around the other wire. A voltage imbalance would then be produced and one way for the imbalance to be resolved would be for current to flow down a leg wire and across the bridge wire 20 to the other leg wire. Of course, this is precisely what is not wanted since premature and accidental detonation might occur.

In the manner described above, a simple, effective and reliable static electricity suppression system is provided. This system may be used with a variety of electric detonators where prematuare detonation, because of static electricity, is a problem.

It is to be understood that the above-described arrangements are only illustrative of the application of the principles of the present invention. Numerous modfications and alternative arrangements may be devised by those skilled in the art without departing from the spirit and scope of the present invention and the appended claims are intended to cover such modifications and arrangements.

What is claimed is:

1. An electric detonator comprising an electrically conductive shell, an explosive initiating device, at least a portion of which is disposed in the shell, for producing an explosion in response to electrical current, a pair of conductors which extend into the shell and are coupled to the explosive initiating device for carrying electrical current thereto, and means for securing the conductors in place as they enter the shell and for maintaining a section of each conductor in closer proximity both to the shell and to a corresponding section of another conductor at a one location in the shell, than at other locations.

2. An electric detonator as in claim 1 wherein said securing means comprises an electrically non-conductive plug disposed within the shell, and wherein said conductors extend through the plug to connect to the explosive initiating device.

3. An electric detonator as in claim 2 wherein the shell circumscribes the sides of the plug, and wherein the conductors are positioned to extend through the plug near the center thereof spaced from the sides, with sections of the conductors being curved to the sides of the plug to locations adjacent to the shell and adjacent to each other, and then back toward the center of the plug.

4. An electric detonator as in claim 3 wherein the plug is generally cylindrical in shape, wherein the conductors extend generally axially in the plug, wherein the plug includes a segment which is reduced in diameter from the rest of the plug, and wherein the locations of the conductors at the sides of plug are positioned in the segment.

5. An electric detonator as in claim 4 wherein the locations of the conductor sections are spaced from the shell from about 0.005 inch to 0.011 inch, and wherein the locations are spaced from each other, measured from adjacent edges, from about 0.005 inch to 0.026 inch.

6. An electric detonator as in claim 5 wherein the plug is made of phenolic plastic.

7. An electric detonator as in claim 6 wherein the shell is made of an aluminum alloy and wherein the conductors are made of copper.

8. A method of discharging a static charge accumulation from a pair of electrical conductors which carry electrical current to an electric detonator comprising the steps of providing a conductive shell to surround at least a portion of the detonator, arranging the conductors to extend through an opening in the shell to the detonator, and maintaining the conductors generally spaced-apart from one another and from the shell wall, with a portion of each conductor being positioned (a) in close proximity to the shell wall to allow discharge from a conductor to the shell wall of a static charge accumulation on the conductor, and (b) in close proximity to a portion of the other conductor so that upon discharge from one conductor to the shell wall, a discharge between the other conductor and the shell wall is produced.

9. A method as in claim 8 further comprising the steps of providing a plug for insertion in the opening of the shell, and securing the conductors in the plug to extend therethrough to the detonator, with the conductors being positioned centrally in the plug away from the shell wall except for said portions which are directed to the exterior of the plug near the shell wall and then back toward the center of the plug.

10. A method as in claim 9 further comprising the step of providing the plug with a segment which is reduced in circumference, wherein the conductors extend to the exterior of said reduced segment, and wherein the shell is formed to surround the sides of the plug, with the shell being spaced from the exterior of the reduced section and the portions of the conductors by a predetermined distance.

11. In an electric detonator having an electrically conductive housing, an ignition system disposed in the housing, a static electricity protection system including a pair of electrical conductors for carrying electrical current to the ignition system, and a plug disposed in the housing so that the housing walls surround the plug on the side, said conductors being disposed to extend generally centrally through the plug from the top to the bottom, with portions of the conductors being bent to extend toward one another and to the exterior of the plug to locations spaced a certain distance from the housing and from one another, to enable discharge of static charge accumulation from the conductors to the housing.

12. A system as in claim 11 wherein said plug includes a section having a reduced perimeter, wherein the housing surrounds and generally contacts the sides of the plug except for the reduced section, and wherein said portions of the conductors extend to the exterior of the reduced section of the plug.

13. A system as in claim 12 wherein said reduced section of the plug is reduced in radial distance by about 0.005 to 0.011 inch.

14. A system as in claim 13 wherein said portions of the conductors are spaced apart by about 0.005 to 0.026 inch.

15. A system as in claim 14 wherein each of said conductors is exposed at the exterior of the reduced section of the plug over an area of about 0.03 by 0.03 inch.

16. A system as in claim 15 wherein said plug is made of phenolic material.

17. A method of constructing an electric detonator comprising the steps of;

providing a generally hollow cylindrical electrically conductive shell, positioning an explosive initiating device in a lower end of the shell, providing a pair of conductors for carrying electrical current to the explosive initiating device, where a section of each conductor bends outwardly from a certain alignment to locations in close proximity to one another and then back toward the alignment, forming a plug about a segment of the conductors which includes said sections, removing a peripheral portion of the plug to expose the conductors at said locations, and positioning the plug in an upper end of the shell so that the shell circumscribes the plug and is spaced a predetermined distance from the exposed parts of the conductors.

* * * * *